US011506335B2

(12) United States Patent
Seifert et al.

(10) Patent No.: US 11,506,335 B2
(45) Date of Patent: Nov. 22, 2022

(54) TANK LINER HAVING TWO CYLINDRICAL SECTIONS

(71) Applicant: Plastic Omnium Advanced Innovation and Research, Brussels (BE)

(72) Inventors: Axel Seifert, Zonhoven (BE); Geert Nouwen, Alken (BE)

(73) Assignee: PLASTIC OMNIUM NEW ENERGIES FRANCE, Lyons (FR)

( * ) Notice: Subject to any disclaimer, the term of this patent is extended or adjusted under 35 U.S.C. 154(b) by 77 days.

(21) Appl. No.: 17/053,650

(22) PCT Filed: Jun. 26, 2019

(86) PCT No.: PCT/EP2019/067075
§ 371 (c)(1),
(2) Date: Nov. 6, 2020

(87) PCT Pub. No.: WO2020/002470
PCT Pub. Date: Jan. 2, 2020

(65) Prior Publication Data

US 2021/0231261 A1 Jul. 29, 2021

(30) Foreign Application Priority Data

Jun. 26, 2018 (EP) ..... 18179924

(51) Int. Cl.
*F17C 1/06* (2006.01)
*F17C 1/16* (2006.01)
*F17C 13/08* (2006.01)

(52) U.S. Cl.
CPC ..... *F17C 1/06* (2013.01); *F17C 1/16* (2013.01); *F17C 13/083* (2013.01);
(Continued)

(58) Field of Classification Search
CPC ..... F17C 2201/01; F17C 2201/0104; F17C 2201/0123; F17C 2201/0128;
(Continued)

(56) References Cited

U.S. PATENT DOCUMENTS 2,901,592 A 8/1959 Rosshein
8,016,322 B2 * 9/2011 Keehan ..... B61D 5/00 264/516
8,608,013 B2 12/2013 Cola
2005/0161934 A1 * 7/2005 Rife ..... B60K 15/063 280/783
(Continued)

FOREIGN PATENT DOCUMENTS

CN 103596790 A 2/2014
CN 106852167 A 6/2017
(Continued)

OTHER PUBLICATIONS

International Search Report dated Oct. 7, 2019 in PCT/EP2019/067075 filed on Jun. 26, 2019.

*Primary Examiner* — Don M Anderson
(74) *Attorney, Agent, or Firm* — Oblon, McClelland, Maier & Neustadt, L.L.P.

(57) ABSTRACT

A plastic tank liner for the storage of a pressurized fluid includes: two ends; two elongated cylindrical sections, the two cylindrical sections having different diameters; and one connecting section connecting the two cylindrical sections. The connecting section has a concave portion connected to the cylindrical section of smaller diameter, and a convex portion adjacent to the cylindrical section of larger diameter. The convex portion has an isotensoid shape. Two convex domes are located on both ends of the plastic tank liner so that each of the domes is connected to a different cylindrical section.

13 Claims, 4 Drawing Sheets

(52) U.S. Cl.
CPC .... *F17C 13/084* (2013.01); *F17C 2201/0123* (2013.01); *F17C 2203/0604* (2013.01); *F17C 2203/066* (2013.01); *F17C 2203/067* (2013.01); *F17C 2203/0665* (2013.01); *F17C 2270/0168* (2013.01)

(58) Field of Classification Search
CPC ..... F17C 2201/0138; F17C 2201/0147; F17C 2201/0152; F17C 1/06; F17C 1/16; F17C 13/083; F17C 13/084; F17C 2203/0604; F17C 2203/066; F17C 2203/0665; F17C 2203/067; F17C 2270/0168; F17C 2201/0109; F17C 2201/0166; F17C 2201/032; F17C 2201/056; F17C 2203/0619; F17C 2205/013; F17C 2260/018; F17C 1/00
See application file for complete search history.

(56) References Cited

U.S. PATENT DOCUMENTS

| | | | | |
|---|---|---|---|---|
| 2006/0049195 | A1* | 3/2006 | Koussios | B29C 70/222 220/581 |
| 2006/0214415 | A1 | 9/2006 | Rife et al. | |
| 2010/0230417 | A1 | 9/2010 | Berglund | |
| 2012/0193244 | A1 | 8/2012 | Cola | |
| 2012/0241461 | A1* | 9/2012 | Cola | F17C 1/16 220/582 |
| 2018/0127064 | A1* | 5/2018 | Werner | F17C 1/02 |

FOREIGN PATENT DOCUMENTS

| | | | |
|---|---|---|---|
| DE | 10 2016 206 845 | A1 | 10/2017 |
| EP | 2 438 346 | B1 | 4/2012 |
| RU | 2 215 216 | C2 | 10/2003 |

* cited by examiner

TANK LINER HAVING TWO CYLINDRICAL SECTIONS

The present invention concerns vehicle tanks.

In particular, the present invention relates to the liners of tanks for the storage of pressurized fluid, such as a composite pressure vessel.

Such conventional tanks are known in the state of the art as comprising a metallic or plastic liner divided in three parts: a central cylindrical part or section, arranged between two convex domes forming the ends of the liner. Fibers filaments are wound around the plastic liner, either in a helical or in a circular manner, in order to create a stress resistant composite laminate forming the tank.

However, a drawback of this kind of tank is that, when it is needed to increase the fluid storage volume in a vehicle, it is difficult to introduce several of such tanks, because of the rounded shapes of the liners that make difficult to place them close to each other in a common small space.

The object of the invention is to propose a solution to increase the pressurized fluid storage volume in a vehicle.

According to a first aspect of the invention, a plastic tank liner for the storage of a pressurized fluid is provided to this end. The plastic tank liner according to the invention comprises:

- two ends,
- at least two elongated cylindrical sections, the two cylindrical sections or at least two cylindrical sections having different diameters,
- at least one connecting section connecting two cylindrical sections and having a concave portion connected to the cylindrical section of smaller diameter and a convex portion adjacent to the cylindrical section of larger diameter, the convex portion having an isotensoid shape,
- two convex domes located on both ends of the plastic tank liner so that each of the domes is connected to a different cylindrical section.

Thereby, the shape of the liner allows to arrange it in a specific space wherein a conventional liner would not fit. In particular, the section of smaller diameter can be arranged in a narrower space than the section of higher diameter. The liner can thus be arranged in a specific manner to be combined with other neighboring components. Thereby, the pressurized fluid storage volume is increased by optimizing the volume occupied by the liner in a vehicle with respect to other components of the vehicle. Concerning the connecting section, the convex portion (also called convex part) connects to the cylindrical section of larger diameter without discontinuity, and the concave portion (also called concave part) connects to the cylindrical section of smaller diameter without discontinuity. The connecting section is thus designed so that no bending stresses are generated in the plastic tank liner during its pressurization. In other words, the liner keeps a stress-resistant shape while presenting multi-diameter containers. The isotensoid shape in the convex portion allows the optimum use of fibers if fibers are wound around the connecting part. Alternatively, the liner can have other shapes, for example an elliptic shape.

Advantageously, the concave portion is adjacent to the cylindrical section of smaller diameter.

Thereby, the connecting section provides a transition shape from the cylindrical section of larger diameter to the cylindrical section of smaller diameter as short as possible.

Alternatively, the concave portion is connected to the cylindrical section of smaller diameter via a convex portion adjacent to the cylindrical section of smaller diameter.

Thereby, the connecting section comprises two convex portions allowing helical fibers to better cover the connecting section.

Advantageously, the cylindrical sections, the at least one connecting section and the domes are arranged along one same main longitudinal axis.

Thereby, the plastic tank liner is easier to manufacture and more resistant to stress.

Preferably, the plastic tank liner comprises a plastic material, more preferable, it is constituted of plastic material.

This material corresponds to the material for a conventional plastic liner, as the liner of the invention does not need specific other materials to be manufactured. For example, the liner may comprise a thermoplastic or a thermoset material.

Advantageously, each convex dome has an isotensoid shape.

Here again, this shape allows the optimum use of fibers if fibers are wound around the domes.

Preferably, at least one cylindrical section has a circular cross-section.

Advantageously, at least one cylindrical section has an elliptic cross-section.

Preferably, the plastic tank liner comprises three elongated cylindrical sections arranged along the longitudinal axis.

Thereby, at least two cylindrical sections have different diameters, while the third one can have a diameter identical to the diameter of the first or second cylindrical section, or even a diameter different from both diameters of the first and second cylindrical section. This liner may be combined with other components or other liners in a complementary manner in a common space. Furthermore, the plastic tank liner can be thus divided in seven parts: two domes forming the ends, three elongated cylindrical sections, and two connecting parts respectively between the cylindrical section of the middle and the cylindrical sections of the ends.

In an embodiment, a cylindrical section of smaller diameter is located between two cylindrical sections of larger diameters.

In a second embodiment, a cylindrical section of larger diameter, is located between two cylindrical sections of smaller diameters.

In another embodiment, a cylindrical section of medium diameter is located between a cylindrical section of smaller diameter and a cylindrical section of larger diameter.

In another embodiment, a cylindrical section of smaller diameter is located between a cylindrical section of larger diameter and a cylindrical section of medium diameter.

In another embodiment, a cylindrical section of larger diameter is located between a cylindrical section of smaller diameter and a cylindrical section of medium diameter.

The liners of each embodiment can be arranged with respect to each other or to other components in order to optimize the fluid storage volume in a vehicle.

According to a second aspect of the invention, a tank is also provided for the storage of pressurized fluid comprising a plastic tank liner as previously defined, and further comprising fibers wound around the plastic tank liner, around one or more cylindrical sections, at least partially around the or at least one connecting section, and at least partially around at least one dome.

Thereby, as in the conventional tanks, the fibers wound around the plastic tank liner allow creating a stress-resistant composite laminate forming the tank. However, given the high cost of some of the fibers materials, it is important to avoid over-designing the composite laminate for keeping a competitive price. That is why the fibers may, if they are wound in a helical way, be wound totally around the cylindrical section and only partially wound around the connecting sections and domes in order to save fibers while keeping the reinforcement effect of the fibers.

For the same reasons of saving fibers, the latter are wound, this time in a circular or circumferential way, only around the cylindrical sections, partially or completely, and not around the domes and around the connecting sections.

Fibers may also be wound around the tank in helical and circular ways, one layer above the others around the mentioned parts of the plastic tank liner.

Preferably, the fibers comprise carbon, glass, aramid and/or basalt.

According to a further aspect of the invention, an assembly is provided, comprising at least two tanks for the storage of a pressurized fluid, each tank including a plastic tank liner, each liner comprising:

two ends, at least two elongated cylindrical sections, the two cylindrical sections or at least two cylindrical sections having different diameters, at least one connecting section connecting two cylindrical sections, two convex domes located on both ends of the plastic tank liner so that each of the domes is connected to a different cylindrical section, the tanks being arranged within a common space so that each cylindrical section of larger diameter of one of the tanks faces a cylindrical section of smaller diameter of the other or of one of the other tanks, and that each cylindrical section of smaller diameter of one of the tank faces a cylindrical section of larger diameter of the other or one of the other tanks, so that the tanks are arranged in a complementary manner to each other in the common space.

Thereby, thanks to the particular shapes of the tanks, an assembly of several of these tanks can be arranged in a vehicle in order to optimize the fluid storage volume.

Finally, in another aspect of the invention, a vehicle comprising a tank as previously defined is provided.

The invention will now be described by way of non-limiting examples and in support to the accompanying figures wherein:

FIG. 1 illustrates a first embodiment of a plastic tank liner according to the invention;

FIG. 2*a* illustrates a first embodiment of a connecting section of the plastic tank liner of FIG. 1;

FIG. 2*b* illustrates a second embodiment of a connecting section of the plastic tank liner of FIG. 1;

Figure 1:
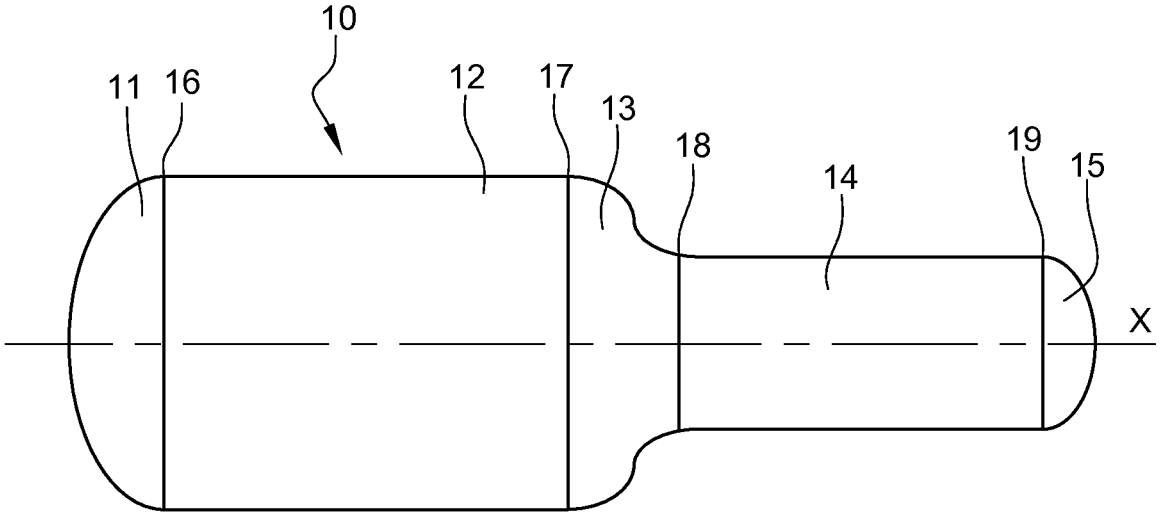

The plastic tank liner 10 of FIG. 1 is a hollow body and comprises a thermoplastic material. It could also be a thermoset material. Alternatively, it could be another plastic material. This liner 10 is intended for a tank for the storage of a pressurized fluid for a vehicle, as it will be described below. The liner is monobloc but may schematically be divided into five hollow parts: the dome 11, the cylindrical section 12, the connecting section 13, the cylindrical section 14 and the dome 15.

The domes 11 and 15 form the ends of the liner 10, one dome at each longitudinal end. Thereby, these domes allow to close the liner at each of its end in a continuous manner, starting from the limit 16 of the cylindrical section 12 for the dome 11, and from the limit 19 of the cylindrical section 14 for the dome 15. Therefore, they have an isotensoid shape, with the same maximal diameter as the cylindrical section to which they are connected. By isotensoid, it is meant that the pressure of fibers which would be wound around this shape would be the same all around the dome. These shapes are thus the most adapted to pressurized fluid tanks which comprise fibers wound around the liner. This type of shape can also be called geodesic-isotensoid contour, as described in US2006049195. Alternatively, they could have other convex shapes or totally different shapes. Furthermore, these domes can have openings in order to introduce inserts into the liner to connect the fluid in the liner to the exterior of the liner.

The cylindrical section 12 has a shape of a cylinder of revolution around the longitudinal axis X, which is the rotational axis of the liner 10. This cylindrical section 12 has a larger diameter than the cylindrical section 14 and extends between two limits 16 and 17 in the longitudinal direction parallel to the axis X. It is an elongated cylindrical section that is closed by the dome 11 which is connected in a continuous manner to the cylindrical section 12 at the limit 16. An elongated cylindrical section is a cylinder wherein the height of the cylinder is greater than the diameter of the cylinder. Furthermore, "in a continuous manner" means "in a gas-tight manner", for example by heat sealing the dome 11 to cylindrical section 12.

The cylindrical section 14 has also a shape of a cylinder of revolution around the axis X but has a smaller diameter than the cylindrical section 12. It is closed by the dome 15 which is connected in a continuous manner to the cylindrical section 14 at the limit 19.

Although these cylindrical sections have the shape of a cylinder revolution, the latter could be different. For example, the cross-section of one or all of these cylindrical sections could be elliptic. In this case, the shape of the domes and of the connecting sections would of course be adapted.

Figure 2A:
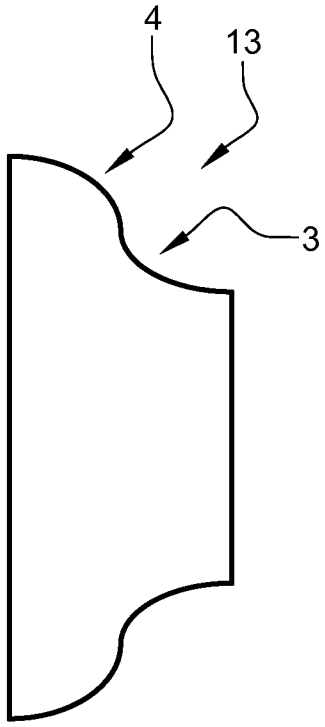
Figure 2B:
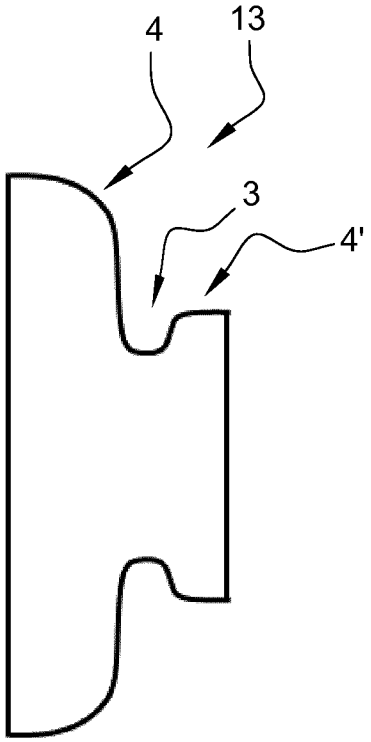

The connecting section 13 extends between the two cylindrical sections 12 and 14. Also illustrated on FIG. 2*a*, this connecting section 13 allows to connect the cylindrical section 12 of larger diameter to the cylindrical section 14 of smaller diameter. This connecting section 13 comprises a concave part 3, connected to the limit 18 of the cylindrical section 14 of smaller diameter, and a convex part 4 of isotensoid shape, connected to the limit 17 of the cylindrical section 12 of larger diameter. This shape allows to connect the two sections of different diameters in a most efficient way with respect to the stress and pressure exerted on the liner 10. Alternatively, the connecting section 13 could have another shape. For example, as illustrated on FIG. 2*b*, the connecting section 13 comprises a convex part 4' connected to the limit 18 of the cylindrical section 14 of smaller diameter, a convex part 4 of isotensoid shape, connected to the limit 17 of the cylindrical section 12 of larger diameter, and a concave part 3 connecting the convex part 4' to the convex part 4 of isotensoid shape.

FIGS. 3 to 6 illustrate tanks comprising the liner 10, with different types of fibers windings. In all these embodiments, the fibers comprise carbon, glass, aramid and/or basalt.

Figure 3:
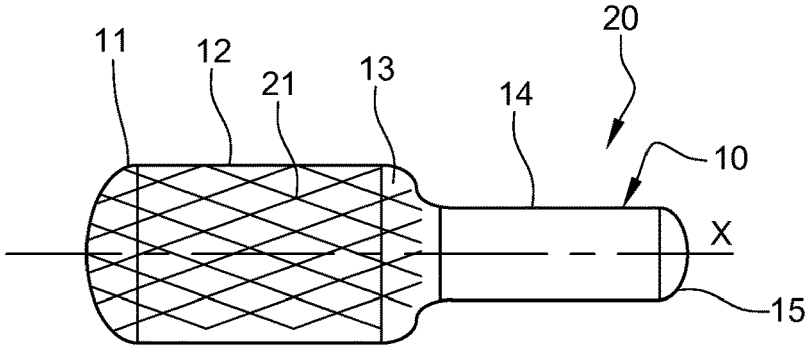
FIGS. 3 to 6 illustrate four embodiments of tanks comprising a plastic tank liner according to FIG. 1, with different respective windings.

The tank 20 of FIG. 3 comprises helical fibers 21. By helical, it is meant that each fiber is wound in a direction neither parallel nor perpendicular to the axis X, but so that the fibers wounds the liner either arounds its perimeter and along a more longitudinal way, as illustrated. In the tank 20, the helical fibers 21 cover entirely the dome 11, entirely the cylindrical section 12, and partially the connecting section 13. However, the cylindrical section 14 and the domes 15 are not covered at all by the helical fibers.

Figure 4:
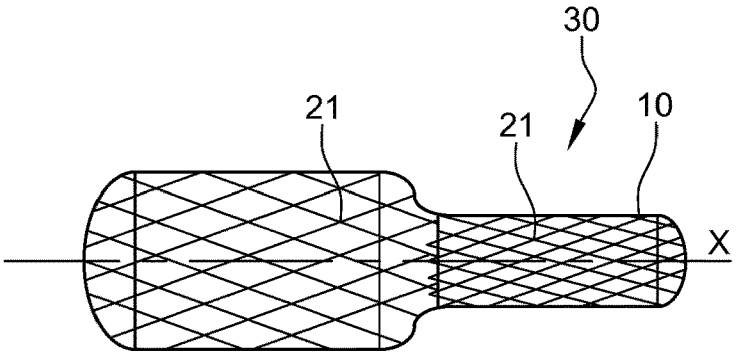

In the tank 30 of FIG. 4, all the parts of the liner 10 are wound by the helical fibers 21.

Figure 5:
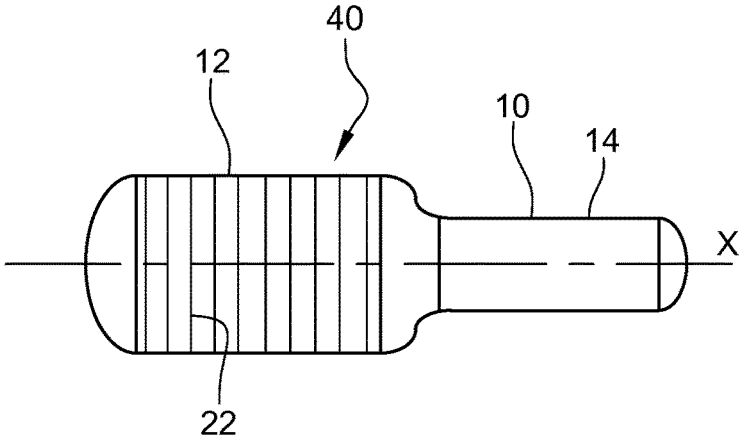
Figure 6:
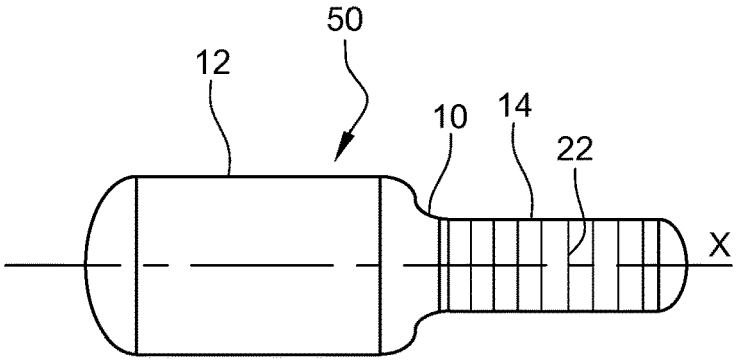

The tanks 40 and 50 illustrated on FIGS. 5 and 6 only comprise circular fibers 22. These fibers 22 wind the tanks only in a circular direction, which can also be called a circumferential direction. This type of wounding winds the tank 40 entirely around the cylindrical section 12, and not at all on other parts, and winds the tank 50 entirely around the cylindrical section 14, and no around other parts.

In a general manner, it is encouraged to place helical windings around at least one of the cylindrical sections completely, around at least one of the connecting sections partially or completely and around domes partially or completely. It is encouraged to place circular windings only around cylindrical sections, completely or partially. Thereby, the use of fibers is economized while keeping the stress-resistant effect they aim at.

It is also possible to wind fibers of the two types, helical and circumferential, on a same tank. For example, a layer of helical fibers 21 can be placed on the liner 10, and then a layer of circumferential layers 22 are placed above, then another one of the same type, then a new layer of helical fibers, etc.

With a liner 10 and fibers 21 and/or 22, a tank for the storage of pressurized fluid, such as gas, is built. Such a tank can be placed in a vehicle and has the advantage of being positionable with respect to its environment, such as other components in the vehicle. For example, the tank may be placed such that the larger diameter cylindrical section extends in a larger space while the smaller diameter section extends in a smaller space, depending on other components surrounding the tank.

A liner of such a tank can also comprise more than two elongated cylindrical sections.

Figure 7:
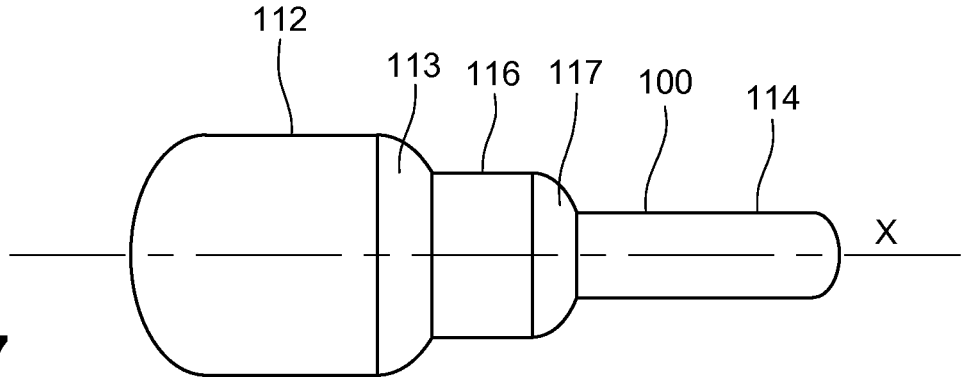
FIGS. 7 to 9 illustrate three embodiments of different tanks.
Figure 8:
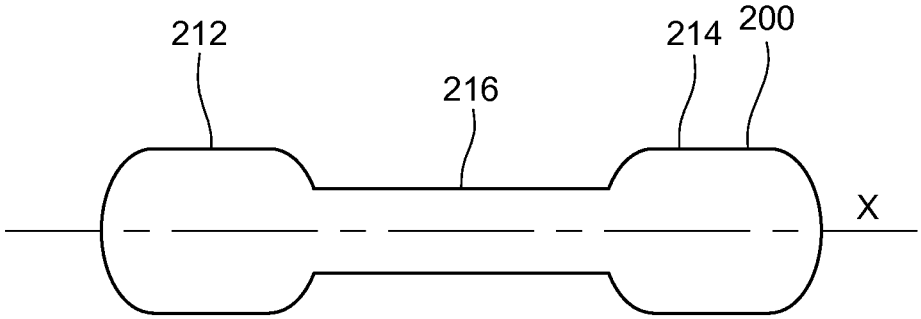
Figure 9:
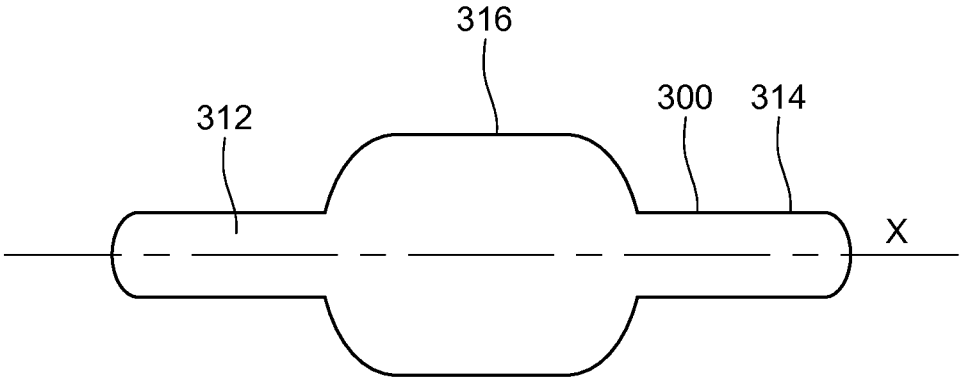

Thus, a liner can comprise three elongated cylindrical sections arranged along the same longitudinal axis X, as illustrated in different embodiments in FIGS. 7 to 9. The liner 100 of FIG. 7 comprises a medium diameter section 116, arranged between a larger diameter section 112 and a smaller diameter section 114. All these sections have a shape of cylinder of revolution around the axis X. The sections 112 and 114 comprise domes closing the liner 100 like the liner 10 described before and having the same properties. Contrary to the liner 10, this liner 100 comprises two connecting sections 113 and 117 respectively between the cylindrical sections 112 and 116 and the cylindrical sections 116 and 114.

These connecting sections 113 and 117 do not have a concave part, they only have a convex part. Alternatively, they could have a convex and a concave part and be identical to the connecting parts previously described, or they can have another shape.

A tank comprising the liner 100 may be interesting to fit in a space comprising more and more volume along a longitudinal axis, inside a vehicle.

The liner 200 comprises a smaller diameter cylindrical section 216 between two cylindrical sections 212 and 214 of larger diameter, with a connecting section between the central smaller diameter section 216 and the larger diameter sections 212 and 214.

The liner 300 has an opposite construction, with a larger diameter section 316 between two sections 314 and 312 of smaller diameter.

Of course, all other arrangements are possible, like a smaller cylindrical section arranged between a larger and a medium diameter sections, or a larger cylindrical section arranged between a smaller section and a medium diameter section. All these embodiments can have circular or elliptic cylindrical sections, or other shapes of cylindrical sections, and all the connecting sections and domes can have any shape either, like convex and isotensoid shapes as the previous liners. Furthermore, a liner can have more than three elongated cylindrical sections with same or different diameters.

Figure 10:
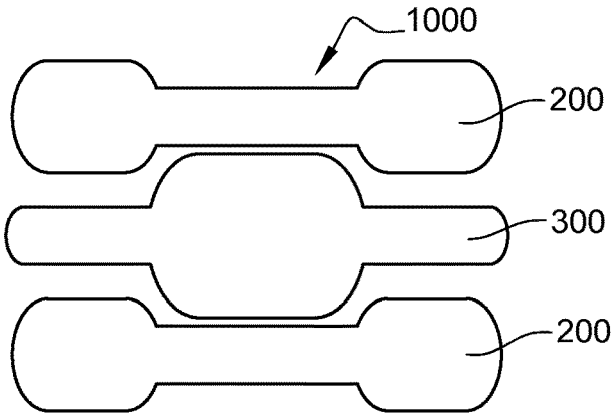
FIG. 10 illustrates an assembly of tanks according to a first embodiment.
Figure 11:
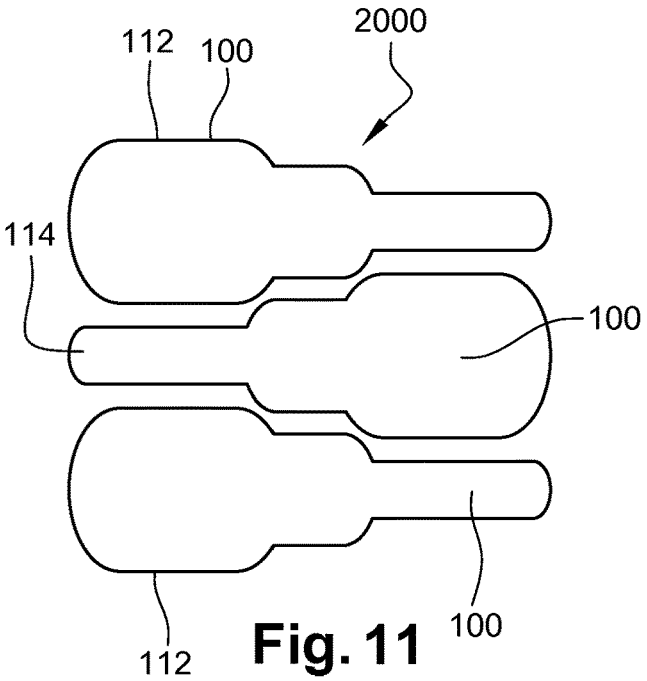
FIGS. 11 and 12 illustrate an assembly of tanks according to a second embodiment with two views.
Figure 12:
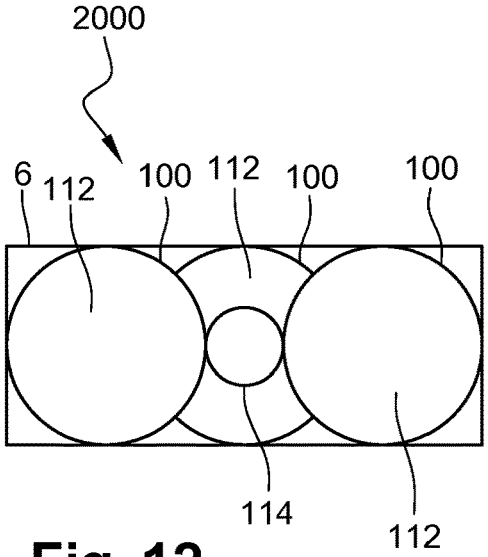
Figure 13:
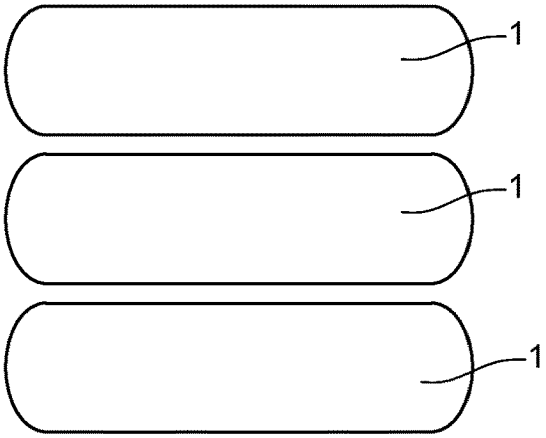
FIGS. 13 and 14 illustrate an assembly of tanks according to the state of the art with two respective views.
Figure 14:
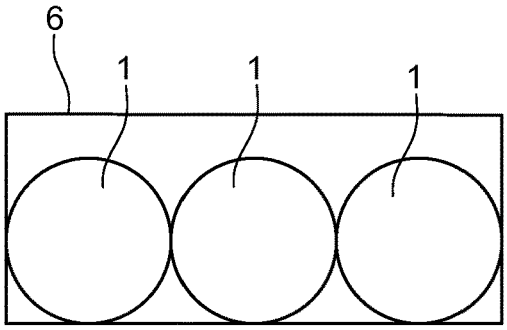

FIGS. 10 to 14 schematically illustrate assemblies of tanks, FIGS. 10 to 12 illustrating liners comprising the previously described liners and FIGS. 13 and 14 illustrating an assembly according to the state of the art. Thus, FIGS. 10 and 11 illustrate two different arrangements of liners depending on their shape in order to optimize the volume occupied by the liner in a common space. The assembly 1000 of FIG. 10 comprises a liner 300 between two liners 200. It can be observed that the cylindrical sections of smaller diameter of the liner 300 face the cylindrical sections of larger diameter of the liners 200 and that the cylindrical section of larger diameter of the liner 300 face the cylindrical section of smaller diameter of the liners 200. In this manner, the volume occupied by the assembly of tanks is optimized.

Although they are not illustrated, the liners can comprise windings as previously described and other components like inserts such that they form complete tanks arranged in respect to each other in the common space. Furthermore, that assembly can comprise means to keep together the tanks or liners in order to behave like one same object.

FIG. 11 illustrates an assembly of three tanks comprising liners 100, the liner 100 of the middle being in an inverse position regarding to the longitudinal direction, with respect to other liners 100. In this manner, the larger diameter section of the liner 100 in the middle of the assembly faces the smaller diameter sections of the two other liners 100, and the smaller diameter section of the liner 100 in the middle of the assembly faces the larger diameter sections of the two other liners 100. Here again the volume occupied by the liners is thus optimized.

FIG. 13 illustrates an assembly comprising three liners 1 with only one cylindrical section, as in the state of the art. The FIG. 12 allows to imagine the volume occupied by the assembly 2000 of FIG. 12 in a common space 6, and to compare it to FIG. 14 which illustrates the volume occupied by the assembly of FIG. 13 in an identical common space 6. It can easily be observed that the assemble 2000 allows to increase the total volume of the liners by optimizing the volume occupied by the liners thanks to their shapes.

Of course, other arrangements, with for example more tanks, are possible. Furthermore, such an assembly can comprise only two tanks or liners, such as the tanks 20, 30, 40 or 50 comprising the liners 10, arranged in a manner that these tanks are complementary to each other in the vehicle.

Thereby, the tanks of the invention allow, thanks to the shape of their liner, to increase the volume of a storage of pressurized fluid in a vehicle.

The tanks for the storage of pressurized fluid described here-above are built in the same way as the tanks of the state of the art or by methods well known by the skilled person. Thus, the plastic liner is formed either by a blow-molding, welding and/or rotational molding process.

Concerning the winding process of these liners, the fibers are wound in the same way as in the state of the art or by means well known by the skilled persons. Thus, some of the fibers extend until a specific position in the connecting part as other fibers conventionally stop in the domes.

The invention claimed is:

1. A tank for the storage of pressurized fluid comprising a plastic tank liner for storage of a pressurized fluid, the plastic tank liner comprising:

two ends;

three elongated cylindrical sections arranged along a longitudinal axis, wherein the three elongated cylindrical sections are configured in one of the following configurations (i), (ii), or (iii):

(i) wherein one of the elongated cylindrical sections, of medium diameter, is located between one of the other elongated cylindrical sections, of smaller diameter, and the other elongated cylindrical section, of larger diameter;

(ii) wherein one of the elongated cylindrical sections, of smaller diameter, is located between one of the other elongated cylindrical sections, of larger diameter, and the other elongated cylindrical section, of medium diameter;

(iii) wherein one of the elongated cylindrical sections, of larger diameter, is located between one of the other elongated cylindrical sections, of smaller diameter, and the other elongated cylindrical section, of medium diameter;

at least one connecting section connecting two of the elongated cylindrical sections and having a concave portion connected to the elongated cylindrical section of smaller diameter and a convex portion adjacent to the elongated cylindrical section of larger diameter, the convex portion having an isotensoid shape; and two convex domes located on both ends of the plastic tank liner so that each of the domes is connected to separate elongated cylindrical sections;

fibers wound in a helical direction around one or more of the three elongated cylindrical sections, at least partially around the or at least one of the at least one connecting section, and at least partially around at least one of the two convex domes;

fibers wound in a circular direction only around one or more of the three elongated cylindrical sections, the fibers around the one or more of the three elongated cylindrical sections in helical and circular directions being wound one layer above the others.

2. The tank for the storage of pressurized fluid according to claim 1, wherein the concave portion is adjacent to the elongated cylindrical section of smaller diameter.

3. The tank for the storage of pressurized fluid according to claim 1, wherein the concave portion is connected to the elongated cylindrical section of smaller diameter via a convex portion adjacent to the elongated cylindrical section of smaller diameter.

4. The tank for the storage of pressurized fluid according to claim 1, wherein the three elongated cylindrical sections, the at least one connecting section and the two convex domes are arranged along one same main longitudinal axis.

5. The tank for the storage of pressurized fluid according to claim 1, wherein each convex dome has an isotensoid shape.

6. The tank for the storage of pressurized fluid according to claim 1, wherein at least one of the elongated cylindrical sections has a circular cross-section.

7. The tank for the storage of pressurized fluid according to claim 1, wherein at least one of the elongated cylindrical sections has an elliptic cross-section.

8. The tank for the storage of pressurized fluid according to claim 1, wherein one of the elongated cylindrical sections, of medium diameter, is located between one of the other elongated cylindrical sections, of smaller diameter, and the other elongated cylindrical section, of larger diameter.

9. The tank for the storage of pressurized fluid according to claim 1, wherein one of the elongated cylindrical sections, of smaller diameter, is located between one of the other elongated cylindrical sections, of larger diameter, and the other elongated cylindrical section, of medium diameter.

10. The tank for the storage of pressurized fluid according to claim 1, wherein one of the elongated cylindrical sections, of larger diameter, is located between one of the other elongated cylindrical sections, of smaller diameter, and the other elongated cylindrical section, of medium diameter.

11. The tank for the storage of pressurized fluid according to claim 1, wherein the fibers comprise carbon, glass, aramid and/or basalt.

12. An assembly comprising at least two tanks for storage of a pressurized fluid, each tank comprising the tank for the storage of pressurized fluid according to claim 1, the tanks being arranged within a common space so that each elongated cylindrical section of larger diameter of one of the tanks faces an elongated cylindrical section of smaller diameter of the other or of one of the other tanks, and that each elongated cylindrical section of smaller diameter of one of the tank faces an elongated cylindrical section of larger diameter of the other or one of the other tanks, so that the tanks are arranged in a complementary manner to each other in the common space.

13. A vehicle comprising the tank for the storage of pressurized fluid according to claim 1.

* * * * *